US005774013A

United States Patent [19]

Groe

[11] Patent Number: 5,774,013

[45] Date of Patent: Jun. 30, 1998

[54] DUAL SOURCE FOR CONSTANT AND PTAT CURRENT

[75] Inventor: John B. Groe, Poway, Calif.

[73] Assignee: Rockwell Semiconductor Systems, Inc., Newport Beach, Calif.

[21] Appl. No.: 565,424

[22] Filed: Nov. 30, 1995

[51] Int. Cl.[6] ..... G05F 1/10

[52] U.S. Cl. ..... 327/543; 327/538; 327/539; 327/541; 323/312; 323/315

[58] Field of Search ..... 327/538, 539, 327/540, 541, 543; 323/312, 313, 315

[56] References Cited

U.S. PATENT DOCUMENTS

| | | | |
|---|---|---|---|
| 4,593,208 | 6/1986 | Single | 327/539 |
| 4,902,915 | 2/1990 | Tran | 327/539 |
| 4,965,468 | 10/1990 | Nicollini et al. | 327/89 |
| 5,208,527 | 5/1993 | Poletto et al. | 323/313 |
| 5,359,552 | 10/1994 | Dhong et al. | 327/539 |
| 5,391,980 | 2/1995 | Thiel et al. | 327/539 |
| 5,448,158 | 9/1995 | Ryat | 323/315 |
| 5,479,092 | 12/1995 | Pigott et al. | 323/313 |
| 5,481,180 | 1/1996 | Ryat | 323/315 |
| 5,512,817 | 4/1996 | Nagaraj | 327/539 |

*Primary Examiner*—Terry Cunningham
*Attorney, Agent, or Firm*—William C. Cray; Susie H. Oh

[57] ABSTRACT

A multi-purpose current source which provides both a PTAT and a constant current source and which requires only one precision external or laser trimmed resistance. The PTAT constant current circuit includes a differential amplifier having one input coupled to a $V_{PTAT}$ reference voltage and the other input coupled to a $V_{bg}$ scaling circuit. The tail current for the differential amplifier is held constant at the current level of an associated constant current source based upon $V_{bg}$. Therefore, the amount of current output from the PTAT current source will be dependent upon the current of the constant current source, rather than upon a resistance value. By setting the scaling circuit appropriately, the current that flows through the output leg of the differential amplifier in the PTAT current source when the ambient temperature is equal to 25° C. will be equal to one half the tail current through the differential amplifier, and thus one half the current output from the constant current source. Since the PTAT current source only requires resistors in the scaling circuit and the value of each of these scaling circuit resistors need be controlled only with respect to each other, there is no need for a precision resistance within the PTAT current source.

9 Claims, 3 Drawing Sheets

DUAL SOURCE FOR CONSTANT AND PTAT CURRENT

BACKGROUND OF THE INVENTION

1. Field of the Invention

This invention relates to analog electronic circuits, and more particularly to current sources for supplying controlled current to electronic devices.

2. Description of Related Art

In some electronic circuits it is desirable or necessary to have a source of current that is regulated to maintain a constant current output. For example, in analog signal processing integrated circuits, data converter circuits, such as analog to digital converters and digital to analog converters, require a fixed current reference that does not change with changes in load or temperature. Any change in the fixed current reference causes inaccuracies in the data conversion process. One circuit which is currently being used to provide such a constant current source is shown in FIG. 1. In FIG. 1 a conventional bias servo network provides a constant current source by driving a bipolar transistor 10 with an operational amplifier 20 to maintain a voltage across a resistor 30 which is equal to a reference bandgap voltage $V_{bg}$. It is clear that the resistor 30 must be precisely controlled in order to accurately set the amount of output current. However, the resistors fabricated in integrated circuits can not be controlled to greater than 15–20% accuracy due to variations in the fabrication process. Therefore, in order to accurately set the current output level the resistor 30 must be an external resistor or, alternatively, the resistor 30 must be laser trimmed. External resistors require far greater space and additional labor, since they must be installed in a separate operation. Likewise, trimming resistors is costly and time consuming.

In addition to the requirement for a current source that remains constant with changes in temperature, some circuits require a current source that compensates for changes that occur within the circuit due to temperature. For example, analog signal processing integrated circuits in which bipolar amplifiers are used are typically biased with a current source commonly referred to as a Proportional To Absolute Temperature ("PTAT") current source. PTAT current sources, as the name implies, vary the current output in proportion to changes in temperature. Bipolar amplifiers typically have a gain, $g_m R_L$; where $R_L$ is the load resistance, $g_m$ is equal to $(ql_c)/(kT)$, $q=1.6\times10^{-19}$ coulomb (i.e., is the electron charge), $I_c$ is the source current, $k=1.38\times10^{-23}$ joule per K (i.e., Boltzmann's constant), and T is current temperature in C°. Variations in the performance of component of the amplifier due to changes in the ambient temperature are compensated by the changes which occur in the current supplied by the current source. FIG. 2 is an illustration of a conventional PTAT current source. A bandgap voltage reference $V_{bg}$ is used to generate a reference voltage that is applied to the base of a bipolar transistor 50. The transistor is biased by a resistor 60 to maintain a current that is proportional to the reference voltage. As is the case with temperature independent current sources such as the source shown in FIG. 1, resistor 60 must be a precision resistor in order to have a precision current output.

Furthermore, it is often necessary to provide one or more constant current sources and one or more PTAT current sources within the same integrated circuit. For example, analog signal processing integrated circuits typically may include for separate classes of circuits: (1) bipolar amplifiers; (2) CMOS amplifiers; (3) Power amplifiers; and (4) data converter circuits. The bipolar amplifiers require a PTAT current source having a first known relationship between the output current and the ambient temperature. A second PTAT current source having a second known relationship between the output current and the ambient temperature is required for supplying current to CMOS amplifiers. A constant current source is required for the power amplifiers to achieve constant output power. Also, data converter circuits require fixed references that are independent of the temperature, variations in the process, and fluctuations and changes in the voltage supply.

The bandgap reference voltage $V_{bg}$ is typically provided by a conventional bandgap reference circuit as shown in FIG. 3 which includes two pairs of bipolar transistors $Q_1$, $Q_2$, $Q_3$, $Q_4$. In one of these two pairs $Q_1$, $Q_2$, one bipolar transistor $Q_2$ is preferably substantially larger than the other $Q_1$. The difference in the size of the two transistors $Q_1$, $Q_2$ results in a difference in the current density with equal current flowing within each transistor. The difference in current density with equal current flowing results in a difference in the voltage drop across the base to emitter of each transistor, $V_{be1}$, $V_{be2}$. A resistor $R_6$ coupled between the emitter of the larger transistor $Q_2$ and ground provides a resistance across which the voltage $\Delta v_{be}$ is dropped. An additional resistor $R_5$ is coupled to the collector of the $Q_2$. The bandgap reference voltage equals:

$$V_{bg}=V_{be2}+\Delta v_{be}(R_5+R_6)/R_6$$

Therefore, the reference can be designed to be independent of temperature providing the temperature coefficient of $V_{be1}$ cancels the temperature coefficient of $\Delta v_{be}$ which can be scaled by setting the value of $R_5$.

Furthermore, the PTAT reference voltage for use in generating a constant current source is typically provided by the bandgap reference circuit using the same two transistors and each of the same resistances. In addition, a third resistor is provided coupled to the emitter of $Q_4$. The PTAT reference voltage $V_{PTAT}$ is taken at the emitter to $Q_4$. The PTAT reference voltage is equal to:

$$V_{PTAT}=V_{be2}+\Delta v_{be}(R_4+R_5+R_6)/R_6.$$

Therefore, by setting each of the resistors $R_4$, $R_5$, $R_6$ to a desired value with respect to each other, the change in $V_{PTAT}$ over temperature can be set to a desired value which will result in a PTAT current source that properly compensates for temperature variations in the circuits to which the PTAT current is supplied.

The use of the constant current source circuit of FIG. 1 and the PTAT current source circuit of FIG. 2 together with the reference voltage circuit of FIG. 3 provides reasonably good current sources. However, if each current source is independent, then a conventional analog signal processing integrated circuit would require at least one external or internal resistance for each current source. Each such resistance must be laser trimmed or otherwise calibrated to set the current level with a sufficient accuracy. External resistors are relatively large with respect to integrated resistors and require additional labor to install.

Accordingly, it would be desirable to provide a current source that is capable of providing more than one constant current source, as well as more than one PTAT current source without the need for more than one external or laser trimmed resistor. The present invention provides such a current source.

SUMMARY OF THE INVENTION

The present invention is a multi-purpose current source which provides both a PTAT and a constant current source and which requires only one precision external or laser trimmed resistance.

In accordance with the present invention, the PTAT constant current circuit includes a differential amplifier having one input coupled to a $V_{PTAT}$ reference voltage and the other input coupled to a $V_{bg}$ scaling circuit. Alternatively, the other input may be coupled directly to $V_{bg}$, The tail current for the differential amplifier is held constant at the current level of an associated constant current source based upon $V_{bg}$. Therefore, the amount of current output from the PTAT current source will be dependent upon the current of the constant current source and the ratio of $V_{PTAT}$ to $V_{bg}$, rather than upon a resistance value. By setting the scaling circuit appropriately, the current that flows through the output leg of the differential amplifier in the PTAT current source when the ambient temperature is equal to 25° C. will be equal to one half the tail current through the differential amplifier, and thus one half the current output from the constant current source. Since the PTAT current source only requires resistors in the scaling circuit and the value of each of these scaling circuit resistors need be controlled only with respect to each other, there is no need for a precision resistance within the PTAT current source.

The details of the preferred embodiment of the present invention are set forth in the accompanying drawings and the description below. Once the details of the invention are known, numerous additional innovations and changes will become obvious to one skilled in the art.

BRIEF DESCRIPTION OF THE DRAWINGS

Like reference numbers and designations in the various drawings refer to like elements.

DETAILED DESCRIPTION OF THE INVENTION

Throughout this description, the preferred embodiment and examples shown should be considered as exemplars, rather than limitations on the present invention.

Overview

The present invention is a current source which is capable of providing one or more temperature independent current sources (hereafter referred to as "Constant" Current Sources), and one or more temperature dependent current sources (hereafter referred to as "PTAT" Current Sources). A single precision resistance is required to precisely set the voltage levels of multiple Constant Current Sources and the PTAT Current Sources.

Figure 1:
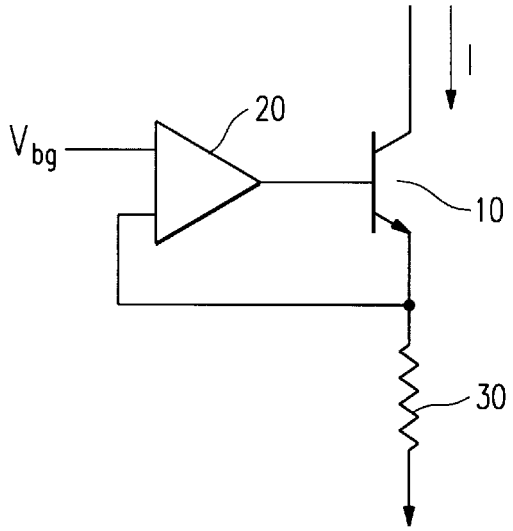
FIG. 1 PRIOR ART
FIG. 1 is a conventional constant current source circuit.
Figure 2:
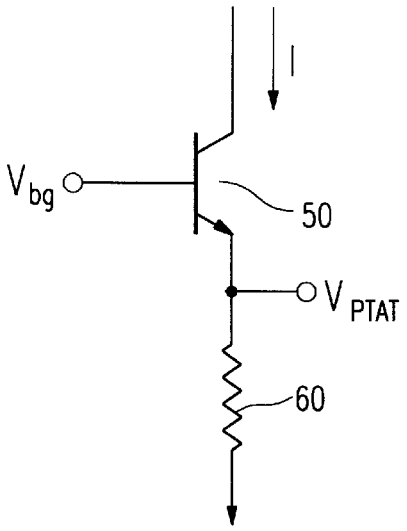
FIG. 2 PRIOR ART
FIG. 2 is an illustration of a conventional PTAT current source.
Figure 3:
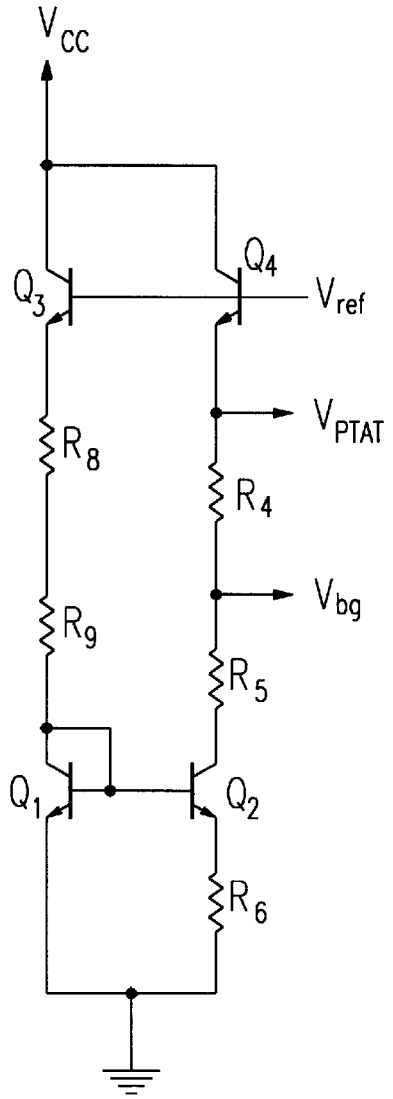
FIG. 3 PRIOR ART
FIG. 3 is an illustration of a conventional bandgap voltage reference circuit.
Figure 4:
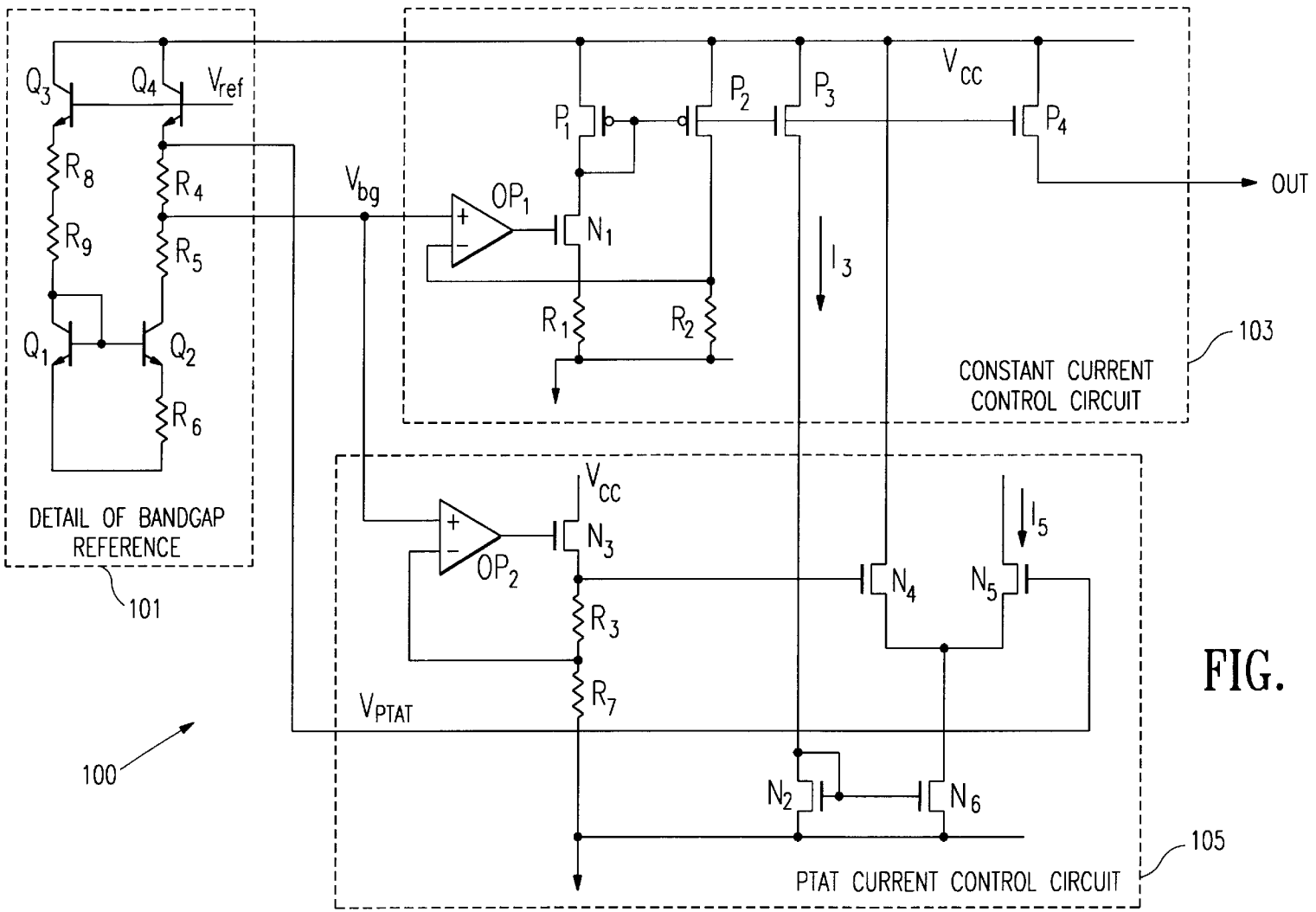
FIG. 4 is an illustration of a Multi-purpose Current Source Circuit in accordance with one embodiment of the present invention.

FIG. 4 is an illustration of a Multi-purpose Current Source Circuit 100 in accordance with one embodiment of the present invention. The circuit of FIG. 4 includes a Bandgap Reference Circuit 101, a Constant Current Control Circuit 103, and a PTAT Current Control Circuit 105. The heart of the invention lies in the coupling of the constant current circuit to the PTAT Current Control Circuit and the architecture of the PTAT Current Control Circuit. The Bandgap Reference Circuit 101 is essentially conventional and is explained in detail to provide a complete understanding of the operation of the present invention.

The Bandgap Reference Circuit 101 provides a constant current reference voltage or bandgap reference voltage $V_{bg}$ to the Constant Current Control Circuit 103 and a PTAT reference voltage $V_{PTAT}$ to the PTAT Current Control Circuit 105. Both $V_{bg}$ and $V_{PTAT}$ are derived from the sum of a bandgap voltage drop which occurs between a first and second terminal of a three terminal bandgap device, such as the base and the emitter of two bipolar transistors $Q_1$ and $Q_2$. Three factors affect the voltage drop that occurs between the base and emitter of a bipolar transistor: (1) ambient temperature in which the device is operating, (2) the physical dimensions of the transistor, and (3) the amount of current flowing out the emitter. The combination of the physical dimensions of the transistor and the amount of current that flows determine the current density. Transistors with the same current density operating at the same ambient temperature will have an equal voltage drop between base and emitter. The greater the current density, the greater the voltage drop.

In the preferred embodiment of the present invention, $Q_2$ is eight times as large as $Q_1$. Therefore, when the same amount of current flows through both $Q_1$ and $Q_2$, the current density within the bandgap of $Q_2$ is one eighth the current density within the bandgap of $Q_1$. This results in a smaller voltage $V_{be2}$ across the base to emitter junction of $Q_2$ than the voltage $V_{be1}$ across the base to emitter junction of $Q_1$. This difference is used to generate $V_{bg}$ and $V_{PTAT}$ in the following manner.

The collectors of $Q_1$ and $Q_2$ are each coupled to two series coupled resistance devices, such as resistors, $R_8$ and $R_9$, and $R_4$ and $R_5$, respectively. Each pair of series resistors is coupled to the emitter of another pair of bipolar transistors, $Q_3$ and $Q_4$. The transistors $Q_3$ and $Q_4$ are base and collector coupled in a current mirror configuration which ensures that the same amount of current flows through both $Q_3$ and $Q_4$. Accordingly, the same amount of current will flow through each leg of the current mirror. That is, the same amount of current will flow through the pair of resistors $R_8$ and $R_9$, and $R_4$ and $R_5$, and through the collectors and emitters of $Q_1$ and $Q_2$. It should be noted that more than two legs may be provided in the current mirror. A resistor, $R_6$ is coupled between the emitter of $Q_1$ and $Q_2$. The emitter of $Q_1$is also coupled to ground (i.e., the negative port of the power supply). Therefore, any difference $\Delta v_{be}$ between the voltages $V_{be1}$ and $V_{be2}$ will be dropped across $R_6$.

The voltage $V_{bg}$ is taken from the point of connection between $R_4$ and $R_5$. Therefore:

$$V_{bg}=V_{be2}+\Delta v_{be}[(R_5+R_6)/R_6] \quad \text{eq. 1}$$

This can be understood by noting that:

$$V_{bg}=V_{ce2}+I_{bg}(R_6+R_5) \quad \text{eq. 2}$$

where; $I_{bg}$ is the current through $Q_2$.

In the preferred embodiment of the present invention, the values of pairs $R_8$ and $R_9$ and $R_4$, and $R_5$ are equal.

Therefore, the voltage at the collectors of both $Q_1$ and $Q_2$ must be equal. Therefore:

$$V_{be1} = V_{ce2} + \Delta v_{be} \quad \text{eq. 3}$$

Furthermore, as stated above:

$$\Delta V_{be} = V_{be1} - V_{be2} \quad \text{eq. 4}$$

Substituting eq. 4 into eq. 3 to solve for $V_{ce2}$:

$$V_{ce2} = V_{be2} \quad \text{eq. 5}$$

Substituting eq. 5 into equation 2:

$$V_{bg} = V_{be2} + I_{bg}(R_{6+R5}) \quad \text{eq. 6}$$

Also noting:

$$I_{bg} = \Delta v_{be}/R_6 \quad \text{eq. 7}$$

Substituting eq. 7 into eq. 5 results in eq. 1.

Figure 5:
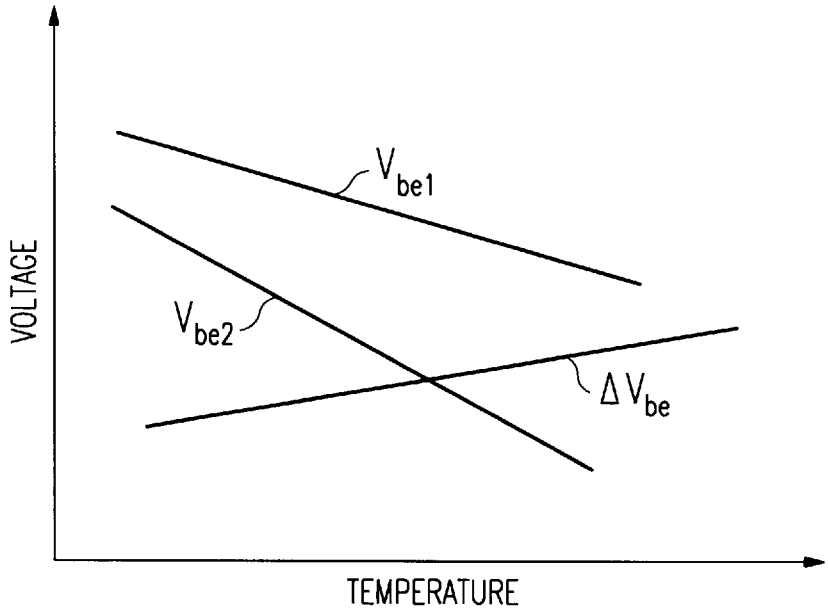
FIG. 5 illustrates the relationship between temperature, $V_{be1}$, $V_{be2}$ and $\Delta V_{be}$.

In the preferred embodiment of the present invention, the sizes of $Q_1$and $Q_2$ are selected such that the temperature effects on $V_{be1}$ are compensated for by the temperature effects on $\Delta v_{be}$. FIG. 5 illustrates the relationship between temperature, $V_{be1}$ $V_{be2}$, and $\Delta v_{be}$. It can be seen that as the temperature rises, both $V_{be1}$ and $V_{be2}$ drop. However, $V_{be1}$ drops at a lesser rate than $V_{be2}$. Therefore, the change in $\Delta V_{be}$ is directly proportional to temperature. That is, as temperature increases, $\Delta v_{be}$ also increases. Therefore, by properly selecting the dimensions of $Q_1$and $Q_2$, and the relative dimensions of $R_5$ and $R_6$, the affect of temperature on $\Delta v_{be}$ will exactly offset the affects of temperature on $V_{be2}$. It should be noted that the factor $[(R_5+R_6)/R_6]$ increases the affect that $\Delta v_{be}$ has on the overall value of $V_{bg}$. Therefore, even though the affect of temperature on $\Delta v_{be}$ is not as great as the affect that temperature has on $V_{be2}$, the factor $[(R_5+R_6)/R_6]$ provides emphasis to allow the affects to cancel. It should also be noted that the values of each of the resistors $R_4$, $R_5$, and $R_6$ are important only with respect to each other. Therefore, process variations do not affect the accuracy of the present circuit.

As shown in FIG. 4, a resistor $R_4$ is coupled to the resistor $R_5$ to add additional resistance to the load across which $V_{PTAT}$ is developed. Accordingly, it will be clear that:

$$V_{PTAT} = V_{be2} + \Delta v_{be}[(R_{4+R5} + R_6)/R_6]$$

The addition of $R_4$ to the equation increases the influence of $\Delta v_{be}$, on $V_{PTAT}$ , and thus makes the influence exerted by $\Delta v_{be}$ dominant over the influence of $V_{be2}$. Therefore, $V_{PTAT}$ will be directly proportional to temperature (i.e., will rise with a rise in temperature). The relationship between $V_{PTAT}$ and temperature will be a function of the value of $R_4$ with respect to $R_5$ and $R_6$.

The $V_{bg}$ output from the Bandgap Reference Circuit 101 is coupled to the input of the Constant Current Control Circuit 103. The Constant Current Control Circuit 103 includes an input operational amplifier $OP_1$. $V_{bg}$ is coupled to the non-inverting input of $OP_1$.

The output from $OP_1$ is coupled to the gate of an N-Channel field effect transistor (FET) $N_1$. The drain of $N_1$ is coupled to the drain of a P-Channel FET $P_1$ which is coupled to three other P-Channel FETs $P_2$–$P_4$ in a current mirror configuration. That is, the gates of P2–P4 are coupled together and the sources are coupled together. Thus, the same volume of current that flows through one must flow through all. A load resistance $R_1$ is coupled to the source of $N_1$. A resistance $R_2$ is coupled to the drain of $P_2$, as is the inverting input to $OP_1$. Thus, $OP_1$ attempts to drive the current mirror comprising $P_2$–$P_4$ to maintain a voltage at the non-inverting input which is equal to $V_{bg}$ (i.e., which is coupled to the non-inverting input). The current that flows through $P_4$ is considered the output current from the Constant Current Control Circuit 103. This current may be used as a source for any device which requires a current source that is independent of temperature. It will be apparent to those skilled in the art that by precisely controlling the value of $R_2$, this output current can be precisely controlled. Each of the other resistors need only be controlled with respect to one another. For example, the resistance of $R_4$ need only be controlled with respect to the values of $R_5$ and $R_6$. Thus, the process variation affects on $R_4$ are the same as each of the other resistors. Therefore, the output current is unaffected by process variations which affect the resistance of $R_4$–$R_6$. Those of ordinary skill in the art will understand that relative values of resistance within an integrated circuit may be controlled very precisely. However, the absolute values of resistances is more difficult to control.

As stated above, the heart of the present invention lies in the coupling of the Constant Current Control Circuit 103 to the PTAT Current Control Circuit 105. The current that flows through $P_3$ is coupled to the PTAT Current Control Circuit 105 and couples the Constant Current Control Circuit 103 to the PTAT Current Control Circuit 105 through an N-Channel device $N_2$. The N-Channel device $N_2$ is one half of a current mirror which sets the tail current for a differential amplifier. For example, in the embodiment of the present invention shown in FIG. 4, the two N-Channel FETs $N_4$ and $N_5$ are configured as a differential amplifier. The sum of the current through these two FETs is held constant by the current mirror comprising $N_2$ and $N_6$. Additional legs may be added between $P_3$ to $N_2$ or between $N_2$ and $N_6$.

Also coupled to the PTAT Current Control Circuit 105 is the $V_{PTAT}$ voltage and the $V_{bg}$ voltage output from the Bandgap Reference Circuit 101. The voltage $V_{PTAT}$ is coupled to a first input to the differential amplifier (i.e., the gate of $N_5$). The voltage $V_{bg}$ is coupled to a scaling circuit which in one embodiment comprises a second operational amplifier $OP_2$, as shown in FIG. 4. The output from the scaling circuit is coupled to the second input to the differential amplifier. The scaling circuit provides a means for regulating what portion of the current that flows through $N_6$ will flow through $N_4$, and thus through $N_5$.

The voltage $V_{bg}$ is coupled to the non-inverting input to the operational amplifier $OP_2$. The output of $OP_2$ drives an N-Channel FET $N_3$ which sets a current through two resistances $R_3$ and $R_7$. The point of connection between $R_3$ and $R_7$ is coupled to the inverting input to $OP_2$. Thus, the current through $R_3$ and $R_7$ is held constant by $OP_2$ at a level that causes the voltage across $R_7$ to remain constant. By setting the relative values of the resistor $R_3$ with respect to the resistor $R_7$, the voltage applied to the gate of $N_4$ is preferably set to equal the voltage $V_{PTAT}$ which occurs at a particular ambient operating temperature. In the scaling circuit shown in FIG. 4, the output voltage from the scaling circuit to the gate of $N_4$ is greater than the bandgap reference voltage $V_{bg}$. However, in an alternative embodiment, the voltage applied to the input of the differential amplifier may be any voltage equal to $(1+R_3/R_7)V_{bg}$ and that provides the desired current output from the differential amplifier. It should be apparent to one of ordinary skill in the art that since the ratio of $R_3$ to $R_7$ determines the voltage at the gate of $N_4$, as opposed to the absolute value of either $R_3$ or $R_7$, process variations will not affect the precision with which the voltage at the gate of $N_4$ can be set.

Figure 6:
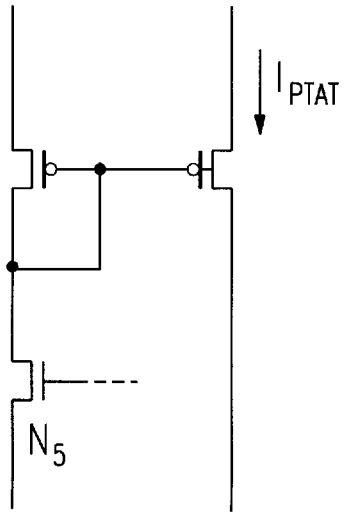
FIG. 6 is an alternative embodiment of a current source in which a current mirror circuit is coupled to the source of an N-Channel FET to provide a current source rather than a current sink as shown in FIG. 4.

In one embodiment of the present invention, $OP_2$ scales $V_{bg}$ to match the $V_{PTAT}$ at 25° C. Therefore, at 25° C. approximately half the current that flows through $N_2$ will flow through each of the FETs of the differential pair. In accordance with one embodiment of the present invention, the output of the PTAT Current Control Circuit 105 is taken as a current sink through $N_5$. Alternatively, a current source may be provided by coupling a current mirror circuit to the source of $N_5$ as shown in FIG. 6. As the temperature increases, $V_{bg}$ remains constant, $V_{PTAT}$ increases, and additional tail current is steered through $N_5$. The steering is linear and depends only on the change in $V_{PTAT}$ and the device characteristics of $N_4$ and $N_5$. It can be seen that the current which flows through the device $N_5$ is proportional to absolute temperature and is closely related to the constant current which flows through $P_3$.

SUMMARY

Figure 7:
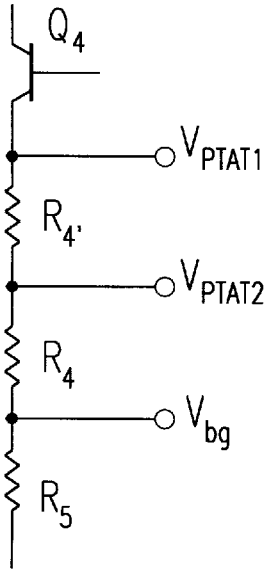
FIG. 7 is an illustration of an embodiment of the present invention in which an additional resistance is used to generate an additional PTAT Voltage having a different temperature characteristic.

It will be apparent to those skilled in the art that the present invention provides both a PTAT current and a temperature independent constant current source which require only one precision resistance (i.e., $R_2$, in the embodiment shown in FIG. 4). Additional PTAT voltages and bandgap voltages may be generated by the Bandgap Reference Circuit 101 and applied to additional PTAT Current Control Circuits or Constant Current Control Circuits to generate additional current sources. For example, as shown in FIG. 7, an additional resistance $R_4$, may be used to generate an additional PTAT voltage which has a different temperature characteristic (i.e., relationship between temperature and voltage). Such additional PTAT voltages may be applied to additional PTAT Current Control Circuits which are essentially identical to the circuit shown in FIG. 4. By varying the ratio of the resistors $R_3$ and $R_7$, the relative amount of current that flows through each portion of the differential amplifier may be varied to bias the differential amplifier at any operating temperature independent of any other PTAT current sources. That is, the second input to the differential amplifier may be set such that equal current flows through each leg of the differential amplifier at virtually any operating temperature.

A number of embodiments of the present invention have been described. Nevertheless, it will be understood that various modifications may be made without departing from the spirit and scope of the invention. For example, the differential amplifier of the present invention may be any differential type amplifier capable of providing an output current that is proportional to the ratio of the voltages applied to each of two inputs, and wherein the total current through the differential amplifier is equal to a regulated current. In addition, the scaling circuit may be any voltage divider circuit which is capable of providing a useful range of voltage levels based upon the bandgap reference voltage $V_{bg}$. Furthermore, while the present invention is described as being implemented using bipolar transistors and field effect transistors, a broad range of active devices may be used in place of these devices. For example, MOSFETs, vacuum tubes, etc. may be used. In addition, any device which provides resistance may be used in place of the resistors illustrated and described above. Still further, the resistors of the present invention may be any resistive element, such as wire wound resistors, carbon composite resistors, carbon film resistors, integrated circuit resistors deposited upon a substrate, etc. Accordingly, it is to be understood that the invention is not to be limited by the specific illustrated embodiment, but only by the scope of the appended claims.

I claim:

1. A proportional to absolute temperature (PTAT) current source including:

(a) a reference voltage circuit having a temperature independent voltage output and a temperature dependent voltage output;

(b) a temperature independent current source, coupled to the temperature independent voltage output, having a temperature independent current output; and (c) a temperature dependent current control circuit including:

(1) a current mirror having at least two legs, the first leg being coupled to the output from the temperature independent current source, such that each leg of the current mirror carries the same amount of current as is output from the temperature independent current source;

(2) a differential amplifier coupled to the second leg of the current mirror such that the second leg of the current mirror sinks the tail current from the differential amplifier, a first of the differential inputs being coupled to the temperature dependent voltage output and a second of the differential inputs being coupled to the temperature independent voltage output;

wherein the differential amplifier provides a current sink which is proportional to the temperature dependent voltage output and which is set by the temperature independent voltage output.

2. A proportional to absolute temperature (PTAT) current source including:

(a) a reference voltage circuit having a temperature independent voltage output and a temperature dependent voltage output;

(b) a temperature independent current source, coupled to the temperature independent voltage output, having a temperature independent current output; and (c) a temperature dependent current control circuit including:

(1) an operational amplifier having an output, a non-inverting input, an inverting input, the non-inverting input being coupled to the temperature independent voltage output;

(2) a current mirror having at least two legs the first leg being coupled to output from the temperature independent current source, such that each leg of the current mirror carries the same amount of current as is output from the temperature independent current source;

(3) a current control device coupled and responsive to the output of the operational amplifier;

(4) a plurality of series coupled two terminal resistance devices coupled at one end to the current control device such that the current through the current control device generates a voltage with respect to a ground at each of the connections to the series coupled two terminal resistance devices, the voltage generated at one such connection being applied to the inverting input of the operational amplifier to cause the operational amplifier to maintain current through the series coupled two terminal resistances that is proportional to the temperature independent voltage output; and (5) a differential amplifier coupled to the second leg of the current mirror such that the second leg of the current mirror sinks the tail current from the differential amplifier, a first of the differential inputs being coupled to the temperature dependent voltage output and a second of the differential inputs being coupled to the series coupled two terminal resistance devices, such that a voltage generated with respect to ground at a connection to at least one of the resistances is applied to the second differential input;

wherein the differential amplifier provides a current sink which is proportional to the temperature dependent voltage output and which is scaled to the temperature independent voltage output.

3. The PTAT current source of claim 2, wherein the voltage reference circuit includes:

(a) a first three terminal bandgap device having a voltage $V_{be1}$ between the first and second terminals, the first terminal being coupled to the third terminal;

(b) a second three terminal bandgap device having a voltage $V_{be2}$ between the first and second terminals, the first terminal of the first bandgap device being coupled to the first terminal of the second bandgap device, the second bandgap device being dimensioned such that $V_{be2}$ is less than $V_{be1}$ with the same amount of current flowing out the second terminal of each bandgap device;

(c) a first two terminal resistive device, the first terminal of which is coupled to the second terminal of the first bandgap device and the second terminal of which is coupled to the second terminal of the second bandgap device;

(d) a first two terminal load resistance device, the first terminal of which is coupled to the third terminal of the second bandgap device;

(e) a second two terminal load resistance device, the first terminal of which is coupled to the second terminal of the first load resistance device and provides the temperature independent voltage output, and the second terminal of which provides the temperature dependent voltage output;

(f) a third two terminal load resistance device, the first terminal of which is coupled to the first and third terminal of the second bandgap device; and (g) a two output current mirror, each output terminal of which provides essentially equal output current, the first output terminal of which is coupled to the second terminal of the second load resistance device, and the second output terminal of which is coupled to the second terminal of the third load resistance device.

4. The PTAT current source of claim 3, wherein the first and second three terminal bandgap devices are each bipolar transistors, the first terminal of each bipolar transistor is a base, the second terminal is an emitter, and the third terminal is a collector.

5. The PTAT current source of claim 4, wherein the current mirror includes a first bipolar transistor which is base and collector coupled to a second bipolar transistor, the emitter of each bipolar transistor being an output terminal from the current mirror.

6. The PTAT current source of claim 4, wherein each two terminal resistive device is a resistor.

7. The PTAT current source of claim 3, wherein each of the elements are fabricated on an integrated circuit substrate.

8. The PTAT current source of claim 2, wherein the reference voltage circuit includes:

(a) a first three terminal device having a voltage between the first and second terminal which is depends upon at least (I) the physical dimensions of the device, (ii) the current density in the device due to the current flowing out the second terminal of the device, and (iii) the ambient temperature in which the device is operating;

(b) a second three terminal device similar to the first three terminal device, the first terminal of which is coupled to the first terminal of the first three dimensional device, the second three terminal device being dimensioned such that the voltage between the first and second terminal at a predetermined temperature and with a predetermined current flowing from the second terminal is less than the voltage between the first and second terminal of the first three terminal device operating at the predetermined temperature and with the predetermined current flowing from the second terminal;

(c) a two terminal device having a predictable relationship between the amount of current that flows through the device and the voltage potential generated between the two terminals of the device, the two terminal device being coupled between the second terminal of the first three terminal device and the second terminal of the second three terminal device, such that the difference in voltage between the voltage from the first to the second terminal of the first three terminal device and the voltage from the first to the second terminal of the second three terminal device is a difference voltage which is generated between the two terminals of the two terminal device; and (d) a plurality of series coupled components coupled to the third terminal of the second three terminal device from which is developed the temperature independent voltage output and at least one temperature dependent voltage output; and wherein the temperature independent current control circuit includes:

(e) a second operational amplifier having an output, a non-inverting input and an inverting input, the non-inverting input of the second operational amplifier being coupled to the temperature independent voltage output;

(f) a second current mirror having at least two legs;

(g) a second current control device coupled and responsive to the output of the second operational amplifier; and (h) a two terminal load resistance in series with a first leg of the second current mirror, a first terminal of the load resistor being coupled to the non-inverting second operational amplifier to maintain a constant current through the two terminal load resistance; and wherein the second leg of the second current mirror provides the current output.

9. The PTAT current source of claim 2, wherein the temperature independent current control circuit further includes:

(a) a second operational amplifier having an output, a non-inverting input, an inverting input, the non-inverting input being coupled to the temperature independent voltage output;

(b) a second current mirror having at least two legs;

(c) a second current control device coupled and responsive to the output of the second operational amplifier;

(d) a two terminal load resistance in series with a first leg of the second current mirror, a first terminal of the load resistor being coupled to the inverting input of the second operational amplifier to maintain a constant current through the two terminal load resistance.

* * * * *